US009434047B2

(12) United States Patent
Lien et al.

(10) Patent No.: US 9,434,047 B2
(45) Date of Patent: Sep. 6, 2016

(54) RETAINER RING

(71) Applicant: Taiwan Semiconductor Manufacturing Company, Ltd., Hsin-Chu (TW)

(72) Inventors: Kuo-Cheng Lien, Zhubei (TW); Hsin-Hsien Lu, Hsin-Chu (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 536 days.

(21) Appl. No.: 13/715,694

(22) Filed: Dec. 14, 2012

(65) Prior Publication Data

US 2014/0134929 A1 May 15, 2014

Related U.S. Application Data

(60) Provisional application No. 61/726,414, filed on Nov. 14, 2012.

(51) Int. Cl.
*B24B 37/32* (2012.01)
*B24B 41/06* (2012.01)

(52) U.S. Cl.
CPC ..... *B24B 37/32* (2013.01); *B24B 41/067* (2013.01)

(58) Field of Classification Search
CPC ..... B24B 37/32; B24B 41/067
USPC ..... 451/285, 286, 287, 288, 398, 442
See application file for complete search history.

(56) References Cited

U.S. PATENT DOCUMENTS

| | | | | |
|---|---|---|---|---|
| 5,533,924 | A * | 7/1996 | Stroupe et al. | 451/286 |
| 5,876,273 | A * | 3/1999 | Yano et al. | 451/288 |
| 5,916,015 | A | 6/1999 | Natalicio | |
| 6,110,025 | A * | 8/2000 | Williams et al. | 451/286 |
| 6,113,468 | A * | 9/2000 | Natalicio | 451/41 |
| 6,390,904 | B1 * | 5/2002 | Gleason et al. | 451/286 |
| 7,094,133 | B2 * | 8/2006 | Masunaga et al. | 451/54 |
| 8,535,121 | B2 * | 9/2013 | Bennett et al. | 451/385 |
| 8,740,673 | B2 * | 6/2014 | Kalenian et al. | 451/397 |
| 2014/0053981 | A1 * | 2/2014 | Chen et al. | 156/345.14 |

FOREIGN PATENT DOCUMENTS

| | | |
|---|---|---|
| JP | 2001096458 A | 4/2001 |
| JP | 2008093810 A | 4/2008 |
| TW | 438647 | 6/2001 |
| TW | I252552 | 4/2006 |

OTHER PUBLICATIONS

Taiwanese Office Action received in Application No. 102134319, mailed Jul. 3, 2015, 7 pages.

* cited by examiner

*Primary Examiner* — Timothy V Eley
(74) *Attorney, Agent, or Firm* — Slater Matsil, LLP

(57) ABSTRACT

A retainer ring for chemical-mechanical polishing or other processes includes an outside ring and an inside ring that is attached to the outside ring. The inside ring is softer than the outside ring in hardness.

20 Claims, 5 Drawing Sheets

RETAINER RING

This application claims the benefit of U.S. Provisional Application Ser. No. 61/726,414, filed on Nov. 14, 2012, entitled "Retainer Ring for Chemical-Mechanical Polishing," which application is hereby incorporated herein by reference.

TECHNICAL FIELD

The present disclosure relates generally to an integrated circuit process tool and more particularly a retainer ring for a chemical-mechanical polishing (CMP) process or other manufacturing process.

BACKGROUND

In a CMP process, a wafer with a weaker structure in mechanical strength, such as a single damascene via structure with a pattern density less than 10%, may suffer serious edge peeling or damage due to the wafer edge being continuously hit against the inside of a retainer ring of a carrier head during the CMP process. For example, weak interfaces, such as with an extremely low-k dielectric material with a dielectric constant k in the range of 1.5-2.5, may delaminate during, e.g., a CMP process, and result in a serious defect.

BRIEF DESCRIPTION OF THE DRAWINGS

Reference is now made to the following descriptions taken in conjunction with the accompanying drawings, in which.

DETAILED DESCRIPTION

Figure 1A:
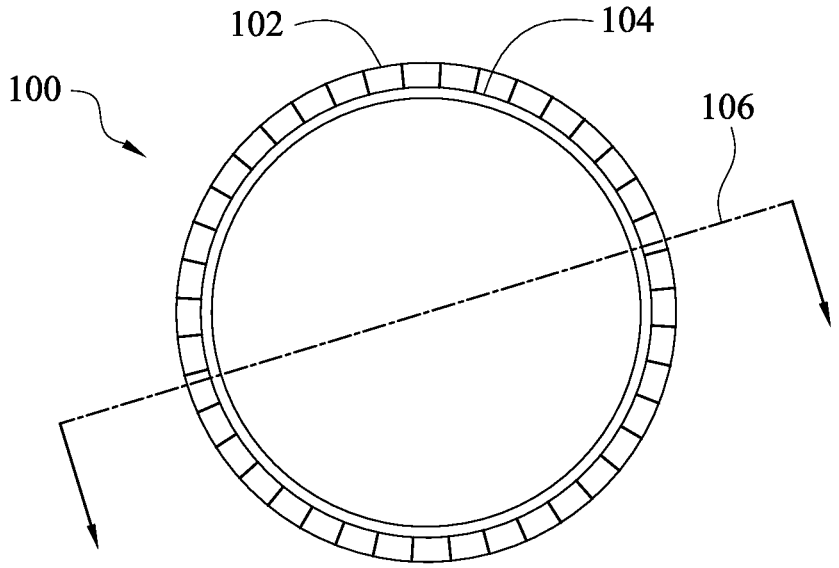
FIG. 1A is a schematic diagram of an exemplary retainer ring for CMP according to some embodiments.

The making and using of various embodiments are discussed in detail below. It should be appreciated, however, that the present disclosure provides many applicable inventive concepts that can be embodied in a wide variety of specific contexts. The specific embodiments discussed are merely illustrative of specific ways to make and use, and do not limit the scope of the disclosure.

In addition, the present disclosure may repeat reference numerals and/or letters in the various examples. This repetition is for the purpose of simplicity and clarity and does not in itself dictate a relationship between the various embodiments and/or configurations discussed. Moreover, the formation of a feature on, connected to, and/or coupled to another feature in the present disclosure that follows may include embodiments in which the features are formed in direct contact, and may also include embodiments in which additional features may be formed interposing the features, such that the features may not be in direct contact. In addition, spatially relative terms, for example, "lower," "upper," "horizontal," "vertical," "above," "over," "below," "beneath," "up," "down," "top," "bottom," etc. as well as derivatives thereof (e.g., "horizontally," "downwardly," "upwardly," etc.) are used for ease of the present disclosure of one features relationship to another feature. The spatially relative terms are intended to cover different orientations of the device including the features.

Figure 1B:
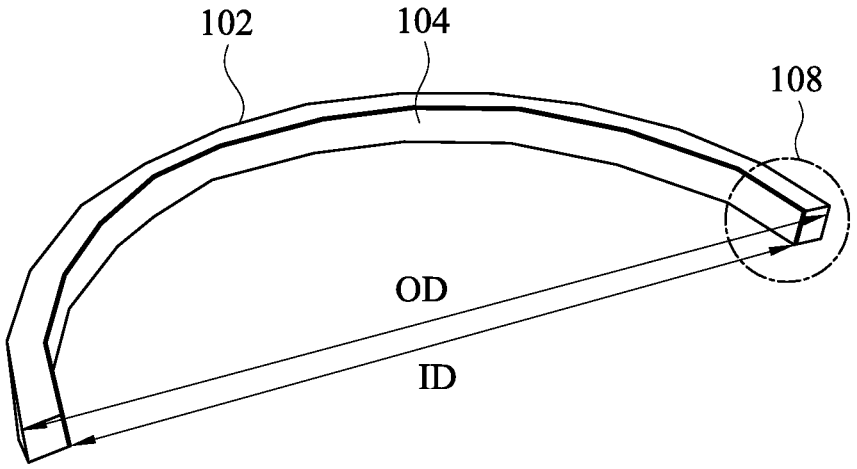
FIG. 1B is a perspective view of the exemplary retainer ring in FIG. 1A cut along the line 106 according to some embodiments.

FIG. 1A is a schematic diagram of an exemplary retainer ring 100 for CMP according to some embodiments. The retainer ring 100 includes an outside ring 102 and an inside ring 104 attached to the outside ring 102. FIG. 1B is a perspective view of the exemplary retainer ring 100 in FIG. 1A cut along the line 106 according to some embodiments. The inside ring 104 is softer than the outside ring 102 in hardness. In some embodiments, the inside ring 104 has a hardness ranging from 15 to 105 in Shore A hardness scale and the outside ring 102 has a hardness ranging from 95 to 110 in Rockwell M hardness scale.

The Shore hardness is a measure of the resistance of a material to penetration of a calibrated spring loaded needle-like indenter, measured by using a durometer. The hardness of polymers (rubbers, plastics) is usually measured by Shore scales. The Rockwell hardness is measured by indenting the test material with a diamond cone or hardened steel ball indenter. The indenter is forced into the test material under a preliminary minor load and the application and removal of an additional major load results in a permanent increase in the depth of penetration that is used to calculate the Rockwell hardness number.

In some embodiments, the inside diameter ID of the retainer ring 100 ranges 300 mm to 303 mm, the outside diameter OD ranges from 329 mm to 333 mm. In other embodiments, the size of the retainer ring 100 can be different, e.g. being sized to accommodate a 450 mm diameter wafer during a CMP process or other process requiring the wafer be retained during a process step.

Figure 1C:
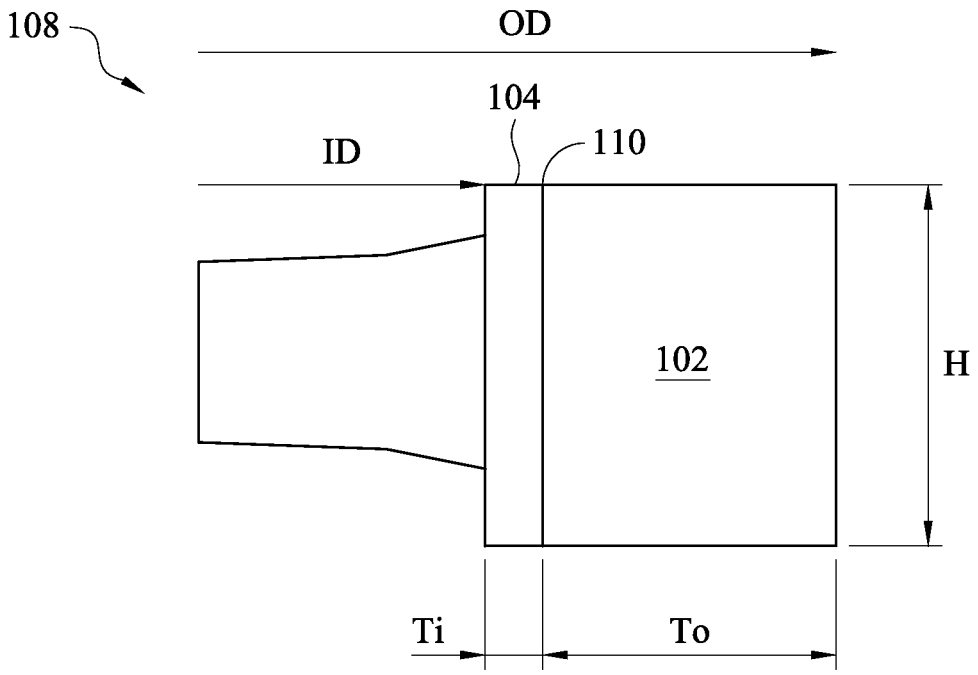
FIG. 1C is a cross section diagram of a portion of the exemplary retainer ring in FIG. 1B according to some embodiments.

FIG. 1C is a cross section diagram of a portion 108 of the exemplary retainer ring in FIG. 1B according to some embodiments. In some embodiments, the inside ring 104 has a thickness Ti ranging from 0.2 mm to 5 mm and comprises polyurethane, polyester, polyether, polycarbonate, any combination thereof, or any other suitable material. In some embodiments, the outside ring 102 has a thickness ranging from 5 mm to 20 mm and comprises polyether ether ketone (PEEK), polyphenylene sulfide (PPS), any combination thereof, or any other suitable material. In some embodiments, the total thickness of the retainer ring 100 that includes the inside ring 104 and the outside ring 102 is kept the same as the thickness of a conventional retainer ring that does not have the inside ring 104.

Figure 1D:
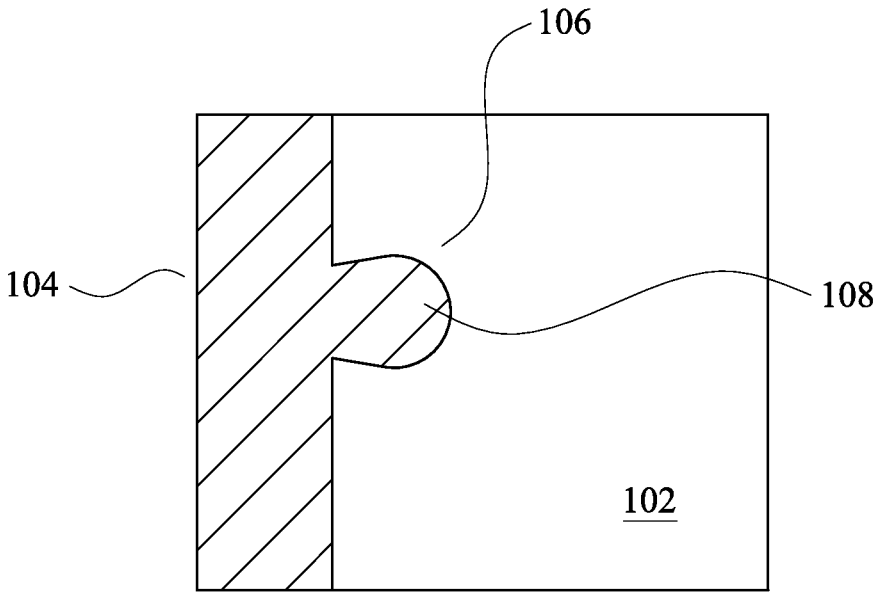
FIG. 1D is a cross section diagram of a portion of the exemplary retainer ring in FIG. 1B according to another embodiment.

In some embodiments, the inside ring 104 is attached to the inside of the outside ring 102 using an adhesive (glue) layer at the interface 110 between the outside ring 102 and the inside ring 104. In other embodiments, the inside ring 104 can be formed inside the outside ring 102 by spread coating. In yet other embodiments, inside outside ring 102 may include a groove 108 running along its inner surface and inside ring 104 may include a protrusion 108 that is engaged with and contained within groove 108, as illustrated in FIG. 1D. Because inside ring 104 is relatively soft, protrusion 108 can deform sufficiently to fit within groove 106 and form a tight friction fitting. Although only one groove 106 and corresponding protraction 108 is shown in FIG. 1D, two or more groove/protrusion pairs could also be employed. In some embodiments, the retainer ring 100 has a height H ranging from 10 mm to 20 mm.

Figure 2A:
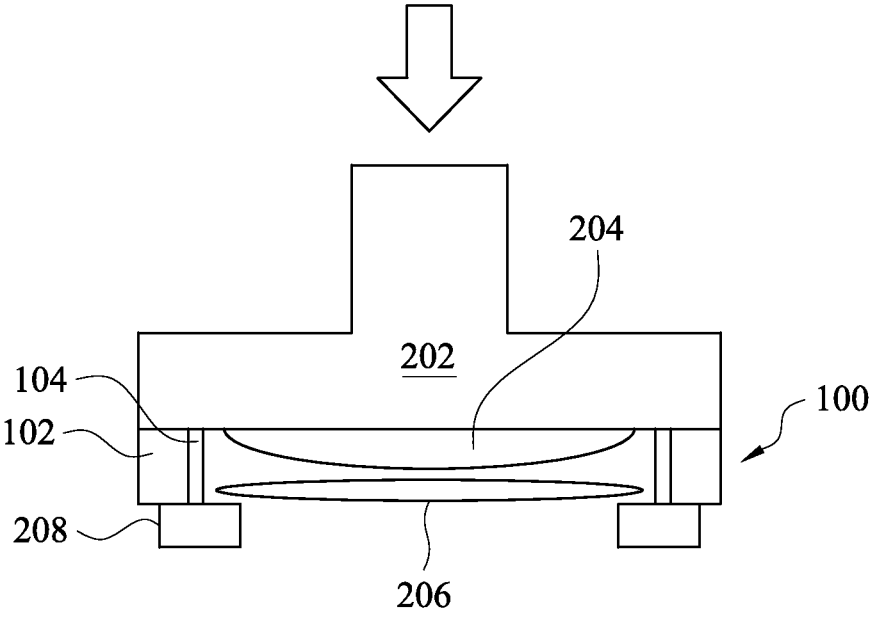
FIGS. 2A-2D are intermediate steps of a method for CMP using the exemplary retainer ring in FIG. 1A according to some embodiments.

FIGS. 2A-2D are intermediate steps of a method for CMP using the exemplary retainer ring 100 in FIG. 1A according to some embodiments. In FIG. 2A, a retainer ring 100 including the outside ring 102 and the retainer ring 100 is mounted to a carrier head 202 using a mechanical fastener such as screws or by any other suitable means. The carrier head 202 has a membrane 204 that will interface the wafer 206. The carrier head 202 is lowered towards a wafer 206 placed on a stage 208.

The inside ring 104 is softer than the outside ring 102 in hardness. In some embodiments, the inside ring 104 has a hardness ranging from 15 to 105 in Shore A hardness scale and the outside ring 102 has a hardness ranging from 95 to 110 in Rockwell M hardness scale.

In some embodiments, the inside ring 104 has a thickness Ti ranging from 0.2 mm to 5 mm and comprises polyurethane, polyester, polyether, polycarbonate, any combination thereof, or any other suitable material. In some embodiments, the outside ring 102 has a thickness ranging from 5 mm to 20 mm and comprises polyether ether ketone (PEEK), polyphenylene sulfide (PPS), any combination thereof, or any other suitable material.

Figure 2B:
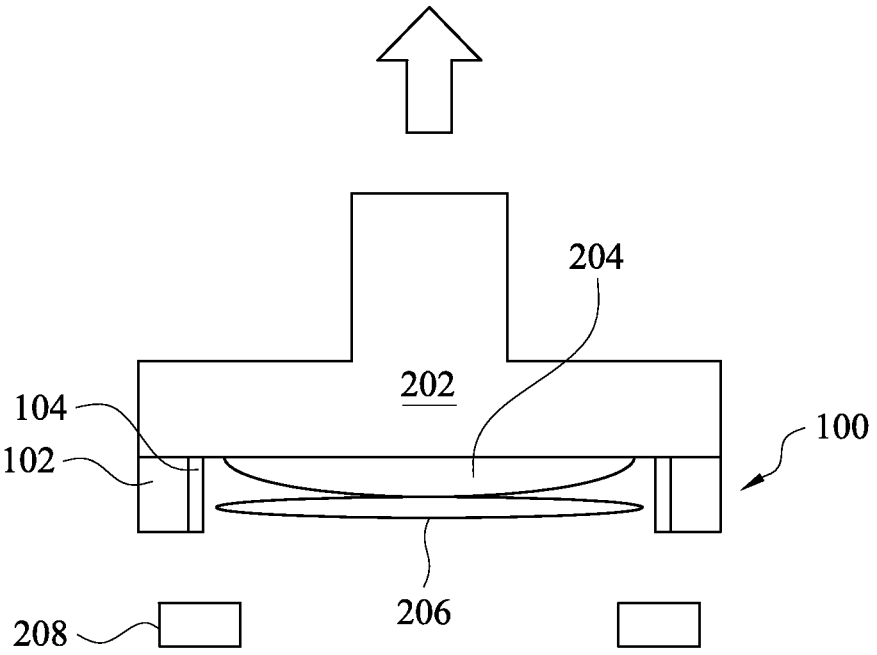

In FIG. 2B, the carrier head 202 picks up the wafer 206 from a stage 208 using vacuum suction on the membrane 204.

Figure 2C:
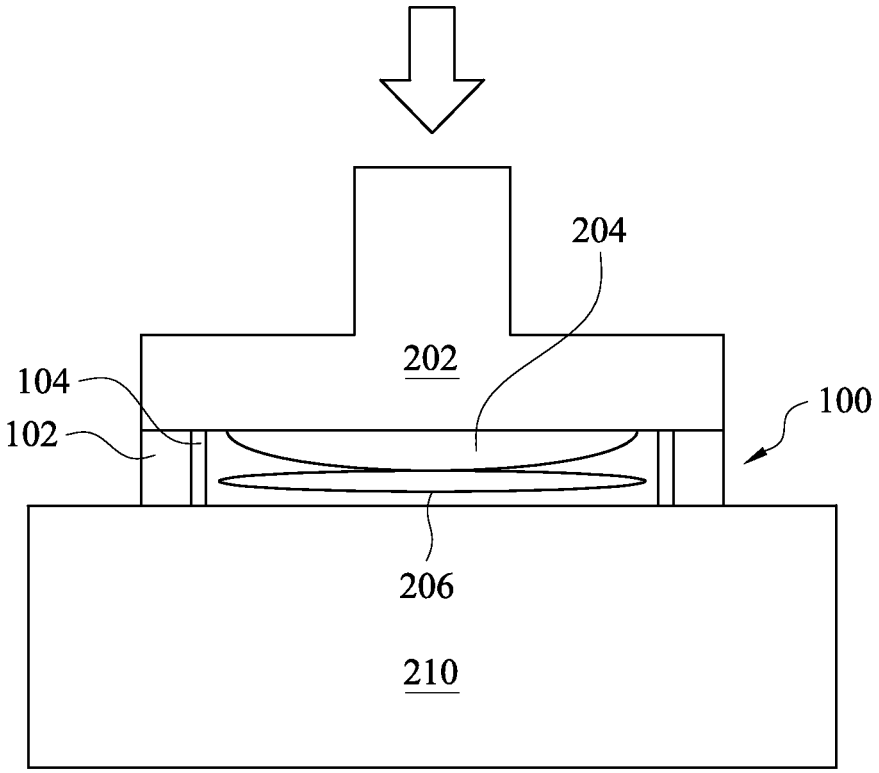

In FIG. 2C, the carrier head 202 carries the wafer 206 to a polish pad 210 and the carrier head 202 is lowered towards the polish pad 210 for polishing the wafer 206. In some embodiments, the gap between the retainer ring 100 and the polish pad 210 ranges from 0.5 mm to 2.5 mm.

Figure 2D:
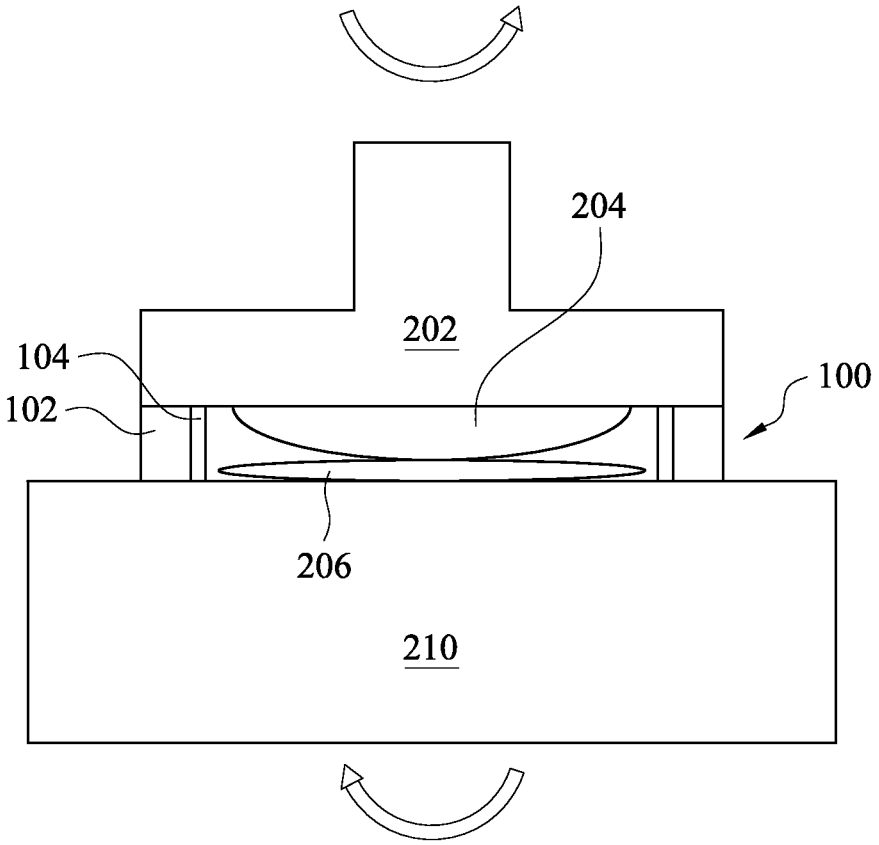

In FIG. 2D, the membrane 204 inside the carrier head 202 is pressurized to push the wafer 206 towards the polish pad 210. The wafer 206 is polished by rotating the carrier head 202 (and/or the polish pad 210). The wafer 206 is confined within the inside ring 104 during the polishing. With the retainer ring 100, the softer inside ring 104 absorbs impact/contact energy and reduces vibrations between the retainer ring 100 and the wafer 206 during the CMP process and prevents damage/peeling on the wafer 206. Also the life time of the retainer ring 100 can be extended.

While the illustrated process is a CMP process, those skilled in the art will recognize that the described retaining ring could provide advantageous features in other manufacturing processes, particularly processes where it is desirable to provide a relatively soft interface to protect wafer edges during processing and/or handling steps.

According to some embodiments, a retainer ring for chemical-mechanical polishing includes an outside ring and an inside ring that is attached to the outside ring. The inside ring is softer than the outside ring in hardness.

According to some embodiments, a method of chemical-mechanical polishing includes picking up a wafer using a carrier head having a retainer ring. The retainer ring includes an outside ring and an inside ring that is softer than the outside ring in hardness. The wafer is polished.

A skilled person in the art will appreciate that there can be many embodiment variations of this disclosure. Although the embodiments and their features have been described in detail, it should be understood that various changes, substitutions and alterations can be made herein without departing from the spirit and scope of the embodiments. Moreover, the scope of the present application is not intended to be limited to the particular embodiments of the process, machine, manufacture, and composition of matter, means, methods and steps described in the specification. As one of ordinary skill in the art will readily appreciate from the disclosed embodiments, processes, machines, manufacture, compositions of matter, means, methods, or steps, presently existing or later to be developed, that perform substantially the same function or achieve substantially the same result as the corresponding embodiments described herein may be utilized according to the present disclosure.

The above method embodiment shows exemplary steps, but they are not necessarily required to be performed in the order shown. Steps may be added, replaced, changed order, and/or eliminated as appropriate, in accordance with the spirit and scope of embodiment of the disclosure. Embodiments that combine different claims and/or different embodiments are within the scope of the disclosure and will be apparent to those skilled in the art after reviewing this disclosure.

What is claimed is:

1. A retainer ring, comprising:

an outside ring with a recess along an inner surface of the outside ring; and an inside ring with a jut extending from an outer surface of the inside ring into the recess, the inside ring being attached to the outside ring by friction between the jut and the recess, wherein the jut has a first width at a first location and a second width at a second location, the second location being interposed between the first location and the outer surface of the inside ring, the first width being greater than the second width, and wherein the inside ring is softer than the outside ring in hardness.

2. The retainer ring of claim 1, wherein the inside ring has a hardness ranging from 15 to 105 in Shore A hardness scale.

3. The retainer ring of claim 1, wherein the inside ring has a thickness ranging from 0.2 mm to 5 mm.

4. The retainer ring of claim 1, wherein the inside ring comprises polyurethane, polyester, polyether, polycarbonate, or any combination thereof.

5. The retainer ring of claim 1, wherein the outside ring has a hardness ranging from 95 to 110 in Rockwell M hardness scale.

6. The retainer ring of claim 1, wherein the outside ring has a thickness ranging from 5 mm to 20 mm.

7. The retainer ring of claim 1, wherein the outside ring comprises polyether ether ketone (PEEK), polyphenylene sulfide (PPS), or any combination thereof.

8. The retainer ring of claim 1, wherein the retainer ring has a height ranging from 10 mm to 20 mm.

9. The retainer ring of claim 1, wherein the inside ring is configured to absorb impact energy and reduce vibrations between the retainer ring and a wafer inside the retainer ring during a chemical mechanical planarization (CMP) process.

10. A retainer ring, comprising:

an outside ring; and an inside ring attached to the outside ring by a friction fitting between a protrusion of the inside ring and a groove of the outside ring, the protrusion having a first width at a first location and a second width at a second location, the first width being less than the second width, the second location being more a distal location of the protrusion from an innermost edge of the inside ring than the first location, wherein the protrusion extends from an outer sidewall of the inside ring into the groove disposed along an inner sidewall of the outside ring, wherein the inside ring is softer than the outside ring in hardness.

11. The retainer ring of claim 10, wherein the inside ring comprises polyurethane, polyester, polyether, polycarbonate, or any combination thereof.

12. The retainer ring of claim 10, wherein the outside ring has a hardness ranging from 95 to 110 in Rockwell M hardness scale.

13. The retainer ring of claim 10, wherein the outside ring comprises polyether ether ketone (PEEK), polyphenylene sulfide (PPS), or any combination thereof.

14. The retainer ring of claim 10, wherein a thickness of the outside ring is in a range from about 5 mm to about 20 mm.

15. The retaining ring of claim 10, wherein a height of the retaining ring is in a range from about 10 mm to about 20 mm.

16. A retainer ring comprising:

an outside ring having a first hardness;

an inside ring having a second hardness, the second hardness being less than the first hardness; and an attachment mechanism connecting the outside ring and the inside ring, comprising:

a groove along an inner surface of the outside ring; and a protrusion of the inside ring configured to fit within the groove and form a friction fitting, the protrusion having a width that increases as the protrusion extends outward.

17. The retainer ring of claim 16, wherein the retaining ring has a height from about 10 mm to about 20 mm.

18. The retainer ring of claim 16, wherein the first hardness is in a range of from about 95 to about 100 in Rockwell M hardness scale and the second hardness is in a range of from about 15 to 105 in Shore A hardness scale.

19. The retainer ring of claim 16, wherein the inside ring comprises polyurethane, polyester, polyether, polycarbonate, or any combination thereof, and the outside ring comprises polyether ether ketone (PEEK), polyphenylene sulfide (PPS), or any combination thereof.

20. The retainer ring of claim 16, wherein the inside ring has a thickness from about 0.2 mm to about 5 mm, and the outside ring has a thickness from about 5 mm to about 20 mm.

* * * * *